US011331904B2

(12) United States Patent
Osborne et al.

(10) Patent No.: US 11,331,904 B2
(45) Date of Patent: May 17, 2022

(54) OVERFLOW CHAMBER FOR PRINT FLUID TANKS

(71) Applicant: Hewlett-Packard Development Company, L.P., Spring, TX (US)

(72) Inventors: William Scott Osborne, Corvallis, OR (US); David D. Welter, Corvallis, OR (US); John James Cantrell, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/261,185

(22) PCT Filed: Nov. 20, 2018

(86) PCT No.: PCT/US2018/062103
§ 371 (c)(1),
(2) Date: Jan. 19, 2021

(87) PCT Pub. No.: WO2020/106283
PCT Pub. Date: May 28, 2020

(65) Prior Publication Data
US 2021/0268792 A1 Sep. 2, 2021

(51) Int. Cl.
*B41F 31/02* (2006.01)
*B41J 2/175* (2006.01)

(52) U.S. Cl.
CPC ..... *B41F 31/02* (2013.01); *B41J 2/175* (2013.01)

(58) Field of Classification Search
CPC .... B41J 2/175; B41J 2/17509; B41J 2/17523; B41J 2/17526; B41J 2/17556; B41J 2/17553; B41J 2/1754; B41J 2/17566; B41J 2002/17579
See application file for complete search history.

(56) References Cited

U.S. PATENT DOCUMENTS

| | | | | |
|---|---|---|---|---|
| 6,257,712 | B1 | 7/2001 | Haigo | |
| 7,517,067 | B2 | 4/2009 | Inoue et al. | |
| 8,567,942 | B2 | 10/2013 | Bailey et al. | |
| 9,452,614 | B2 * | 9/2016 | Olsen | B41J 2/17596 |
| 9,751,308 | B2 | 9/2017 | Lecheheb et al. | |
| 10,343,397 | B2 * | 7/2019 | MacKenzie | B41J 2/17596 |
| 10,589,530 | B2 * | 3/2020 | Choy | B41J 2/17553 |

(Continued)

FOREIGN PATENT DOCUMENTS

| | | | |
|---|---|---|---|
| CN | 1135969 | A | 11/1996 |
| CN | 1334197 | A | 2/2002 |

(Continued)

*Primary Examiner* — An H Do
(74) *Attorney, Agent, or Firm* — HP Inc. Patent Department

(57) ABSTRACT

An example of an apparatus is provided. The apparatus includes a feeder tank to provide print fluid to a nozzle. The feeder tank is disposed below the nozzle to maintain a backpressure. The apparatus also includes a vent port to vent the feeder tank to atmosphere. The apparatus further includes an overflow chamber in fluidic communication with the feeder tank. The overflow chamber is disposed below the nozzle. In addition, the apparatus includes a return channel disposed on the overflow chamber to allow print fluid in the overflow chamber to return to the feeder tank.

15 Claims, 7 Drawing Sheets

(56) References Cited

U.S. PATENT DOCUMENTS

| | | | |
|---|---|---|---|
| 2004/0135829 | A1 | 7/2004 | Yoshida |
| 2006/0017787 | A1 | 1/2006 | Inoue et al. |
| 2008/0100678 | A1 | 5/2008 | Childers et al. |
| 2009/0040249 | A1 | 2/2009 | Wouters et al. |
| 2010/0194830 | A1 | 8/2010 | Yoshiike |
| 2012/0262523 | A1 | 10/2012 | Levi et al. |
| 2013/0141497 | A1 | 6/2013 | Boyd et al. |
| 2014/0224139 | A1 | 8/2014 | Nadachi et al. |
| 2016/0023470 | A1 | 1/2016 | Olsen et al. |
| 2018/0281400 | A1 | 10/2018 | Mackenzie et al. |
| 2018/0281429 | A1 | 10/2018 | Choy et al. |

FOREIGN PATENT DOCUMENTS

| | | | |
|---|---|---|---|
| CN | 1616233 | A | 5/2005 |
| CN | 104275937 | A | 1/2015 |
| JP | 2011-240629 | A | 12/2011 |
| WO | WO-2015015261 | A1 | 2/2015 |
| WO | WO-2017074354 | A1 | 5/2017 |
| WO | WO-2017184118 | A1 | 10/2017 |

* cited by examiner

OVERFLOW CHAMBER FOR PRINT FLUID TANKS

BACKGROUND

Printing devices are often used to present information. In particular, printing devices may be used to generate output that may be easily handled and viewed or read by users. Accordingly, the generation of output from printing devices from electronic form continue to be used for the presentation and handling of information. The generation of output may involve depositing a print fluid onto a form of media. Accordingly, print fluid is to be delivered to the media from a storage tank. In some cases, such as 3D printing, print fluid may be used to generate output without depositing print fluid on media.

BRIEF DESCRIPTION OF THE DRAWINGS

Reference will now be made, by way of example only, to the accompanying drawings in which.

DETAILED DESCRIPTION

Figure 1:
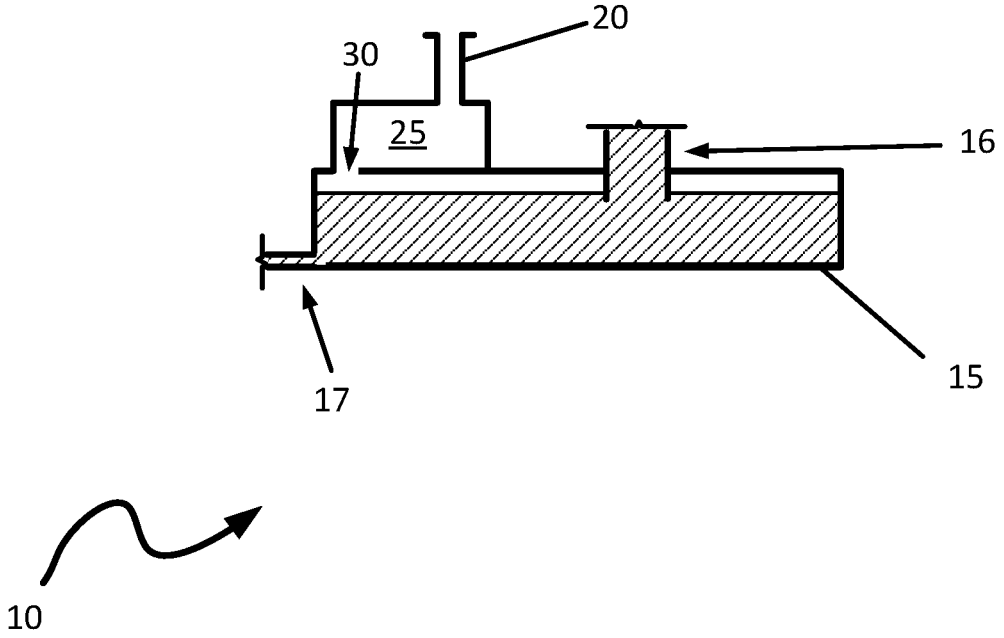
FIG. 1 is a schematic representation of an example apparatus to deliver print fluid to a nozzle of a print head assembly.

As used herein, any usage of terms that suggest an absolute orientation (e.g. "top", "bottom", "vertical", "horizontal", etc.) are for illustrative convenience and refer to the orientation shown in a particular figure. However, such terms are not to be construed in a limiting sense as it is contemplated that various components will, in practice, be utilized in orientations that are the same as, or different than those described or shown.

Some printing devices use print fluids to generate output. In such printing devices, fluid delivery systems are generally used to deliver a liquid from one part of the printing device, such as a storage tank to a print head assembly where output is generated. The storage tanks are generally used to store print fluid such that the print head assembly may be able to receive fluid upon demand for the generation of output. Since the print fluid is used to generate the output, the print fluid is to be stored in a storage tank to provide for continuous operation of the printing device, such as the generation of output from the printing device.

Accordingly, for printing devices which may be used to generate a large amount of documents, print fluid may be stored in a storage tank and supplied to a print head assembly. This allows for continued operation of the printing device over longer periods of time. During operation, the print fluid may be deposited onto the media via a nozzle on the print head assembly. To provide ease of access, such as for replacement or refilling of the print fluid in the storage tank, the storage tank may be placed in an elevated position near the top of the printing device.

As the storage tank is depleted of print fluid, air replaces the print fluid. It is to be appreciated that air typically is more susceptible to thermal expansion than the print fluid. Since the storage tank may experience varying environment conditions, the volume of the air in the storage tank may change resulting in pressure being applied to the surface of the print fluid in the storage tank. For example, if the ambient temperature increases to cause the air in the storage tank to expand, pressure will urge the print fluid out of the storage tank and into the feeder tank. As the feeder tanks get full, this may result in drool from the nozzle or print fluid leaking from a vent port. Accordingly, the drool may result in unintended application of print fluid to the media. In other cases, the drool from the nozzle may result in a mess within the printing device, such as leaking out of the printing device. Similarly, a leak from a vent port may result in the unintended application of print fluid. The drool and vent port leak may be handled by removing the drool or leak, such as with a vacuum and disposing of the leaked print fluid. However, this will result in the wastage of a certain amount of print fluid.

To reduce the likelihood of print fluid wastage, an overflow chamber may be added to the print fluid delivery system, such as in the vent system. In particular, the overflow chamber is to be designed at a lower position than the print head assembly such that gravity will pull the print fluid away from the nozzle to avoid drool caused by pressure from the overflow chamber. However, the overflow chambers will be disposed above the feeder tanks such that they may drain back into the feeder tank as print fluid is used, such as through the print head assembly, or if the original conditions return such that the air in the storage tank returns to its original volume.

Referring to FIG. 1, an apparatus to deliver print fluid to a nozzle of a print head assembly is generally shown at 10. The apparatus 10 may be a part of the printing device or a separate component to operate on the printing device to deliver print fluid to the printing device. In another example, the apparatus 10 may be a separate and consumable part pre-loaded with print fluid to be used with the printing device. In such an example, the apparatus 10 may be disposed of after being depleted. The apparatus 10 may include additional components, such as various additional interfaces and/or connectors to mate with existing connections on the printing device. In the specific example, the apparatus 10 is to provide print fluid to a print head assembly of the printing device while maintaining a negative back pressure from gravity as well as compensating for environmental changes. In the present example, the apparatus 10 includes a feeder tank 15, a vent port 20, an overflow chamber 25, and a return channel 30.

In the present example, the feeder tank 15 is to receive print fluid via the exchange port 16 from a print fluid source, such as a storage tank. The print fluid source is not particularly limited. For example, the print fluid source may be a storage tank in fluidic communication with the feeder tank 15, such as a detachable bottle of print fluid designed to form a connection with the feeder tank 15. Accordingly, the storage tank may be used to store a bulk amount of print fluid to allow for extended operation of the printing device without refilling the storage tank.

In another example, the exchange port 16 of the feeder tank 15 may receive print fluid from a print fluid line (not shown) delivering print fluid from an external tank. The print fluid line may be part of a central print fluid delivery system have a pump or other transport method. It is to be appreciated that the connector is not particularly limited. For example, the connector of the exchange port 16 may include threading mate with a complementary threading on the print fluid source. In other examples, the connector of the exchange port 16 may be a quick connect system. Other manners to connect the print fluid source are also contemplated, such as a mechanism involving guides, tabs, and/or complementary bosses to provide a friction fit.

Furthermore, the feeder tank 15 is in fluidic communication with the nozzle of a print head assembly. In the present example, the feeder tank 15 includes a print fluid outlet port 17 leading to the other parts of the printing device, such as the print head assembly. In the present example, the feeder tank 15 is to be disposed below the nozzle of the print head assembly at a relatively lower position. It is to be appreciated by a person of skill with the benefit of this description that by positioning the feeder tank 15 below the nozzle and by venting the surface of the print fluid in the feeder tank 15 to atmospheric pressure via the vent port 20, a natural backpressure is maintained at the nozzle to reduce drool or leakage from the nozzle. In the present example, the feeder tank 15 is to be disposed within the printing device as part of a print fluid delivery system; however, it is to be appreciated that in other implementations, the feeder tank 15 may be separate.

In the present example, the feeder tank 15 is vented to atmosphere via a vent port 20. In the present example, the vent port 20 may be a simple opening or pathway to the external atmosphere. In other examples, the vent port 20 may include a filter to prevent contaminants from entering the feeder tank 15. In further examples, the vent port 20 may also include a valve or other mechanism to prevent print fluid from escaping via the vent port 20 such as during transport of the apparatus 10.

The construction of feeder tank 15 is not particularly limited and may be constructed from walls using a wide variety of materials. In the present example, the feeder tank 15 is a plastic and may be manufactured using various techniques such as various molding techniques, including injection molding, or 3-D printing. In other examples, the feeder tank 15 may be manufactured from composite materials or metals.

The overflow chamber 25 is in fluidic communication with the feeder tank 15. In the present example, the overflow chamber 25 is also disposed at a position relatively lower than nozzle of the printing apparatus. The overflow chamber 25 is to receive print fluid from the feeder tank 15. The manner by which print fluid may enter the overflow chamber 25 is not particularly limited and the overflow chamber 25 is generally to provide pressure relief on the outlet port 17 to the print head assembly and reduce the likelihood of leakage from the vent port 20. It is to be appreciated by a person of skill in the art that increasing the pressure at the outlet port 17 may cause the nozzle (not shown) to drool in some cases. Alternatively, since the feeder tank 15 is ultimately vented to atmosphere, the increase in pressure may force fluid out of the vent port 20.

The source of an increase in pressure at the feeder tank is not particularly limited. For example, the feeder tank 15 may be in fluidic communication with an external print fluid source that may include a storage tank or print fluid bottle. In some examples, the connection between the feeder tank 15 and the storage tank or print fluid bottle may be a closed system where the storage tank or print fluid bottle is sealed with the feeder tank 15. Accordingly, in such as system, as print fluid enters the feeder tank 15, air from the feeder tank 15, which ultimately comes from the vent port 20, is exchanged into the storage tank or print fluid bottle via the exchange port 16. Therefore, it is to be appreciated that the storage tank or print fluid bottle may have a volume of air above the print fluid. As environmental conditions change in the ambient air surrounding the apparatus 10, the volume of the air in the storage tank or print fluid bottle may change. For example, as the temperature increases, the volume of the air would increase. Although the volume of the print fluid may also increase, the volume change of the air is typically more substantial. The increase in the volume of the air in the storage tank or print fluid bottle above the print fluid may apply a force on the top surface of the print fluid in the storage tank or print fluid bottle which in turn forces some of the print fluid out and into the feeder tank.

Another example of an environmental change that may cause print fluid to be pushed into the feeder tank 15 may be a change in the barometric pressure over time. In the present example, the air in the storage tank or print fluid bottle is to be equilibrated with the ambient pressure which applies a pressure on the print fluid in the feeder tank 15 or the overflow chamber 25. As the print fluid is used by the print head assembly, the print fluid level in the feeder tank 15 is maintained by this equilibrium between the ambient pressure and the pressure of the sealed storage tank or print fluid bottle. Accordingly, with continued use, the print fluid level in the feeder tank 15 will naturally accommodate the pressure changes. However, if the printing device is not used over a period of time, such as several days, the external barometric pressure may rise or fall sufficiently to affect the print fluid levels in the feeder tank 15 since the air in the storage tank or print fluid bottle is trapped and will expand or contract based on the equilibrium with the external barometric pressure. Similarly, if the elevation of the printing device is changed, the ambient pressure may increase or decrease accordingly providing a similar result. For example, if the printing device were to be moved from one floor of an office tower to another floor, the pressure change may be sufficient to cause print fluid to be pushed into the overflow chamber 25 from the feeder tank 15.

Other reasons that may cause print fluid to enter the overflow chamber 25 may be a tipping or other movement of the apparatus 10. For example, during transport of the apparatus 10 or the printing device as a whole, the apparatus may be tilted or inverted. In instances where the apparatus 10 is tilted or inverted temporarily, the overflow chamber 25 may slow the movement of the print fluid to vent port 20 due to the design and placement of the vent port 20 relative to the feeder tank 15. It is to be appreciated that the overflow chamber 25 may also improve the recovery of the print fluid after the apparatus 10 returns to an upright position.

In the present example, the overflow chamber 25 is not particularly limited and may be connected to the feeder tank 15 in various configurations. Furthermore, the construction of the overflow chamber 25, such as the walls is not particularly limited and may use a wide variety of materials. In the present example, the overflow chamber 25 is a plastic and may be manufactured using various techniques such as various molding techniques, including injection molding, or 3-D printing. In other examples, the overflow chamber 25 may be manufactured from composite materials or metals and/or alloys such as aluminum, steel, titanium or other metals. Furthermore, it is to be appreciated that in some examples, the feeder tank 15 and the overflow chamber 25 may be part of a single unitary body constructed from the same material, such as a molded piece of plastic. By using a single unitary body, fewer components would need to be assembled which may reduce manufacturing costs and additional connections which may leak or fail.

The return channel 30 is disposed on the overflow chamber 25. The return channel 30 is to allow for print fluid in the overflow chamber 25 to return to the feeder tank 15 upon the pressure being applied to the feeder tank 15 subsiding. In the present example, the overflow chamber 25 is disposed above the feeder tank 15 and the return channel 30 is a small passage or hole between the feeder tank 15 and the overflow chamber 25. Accordingly, when the pressure in the feeder tank 15 subsides, gravity and the external pressure from the vent port 20 will cause the print fluid in overflow chamber 25 to naturally return to the feeder tank 15.

Figure 2:
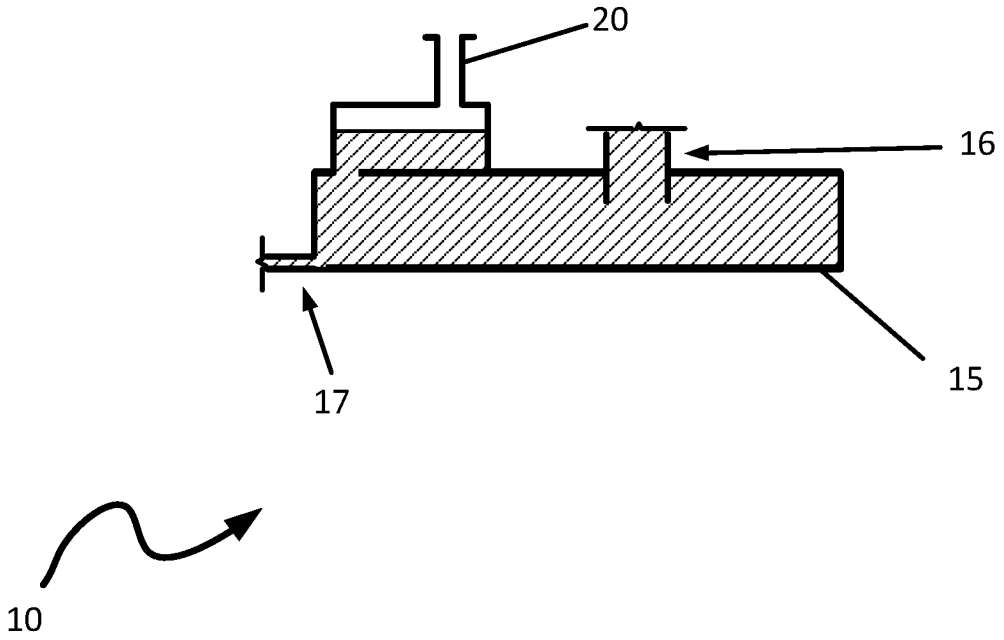
FIG. 2 is a schematic representation the apparatus shown in FIG. 1 in a different state.

Referring to FIG. 2, the apparatus 10 is shown in a state where pressure from the exchange port 16 is applied to the print fluid in the feeder tank 15. As shown, the print fluid is pushed from the feeder tank 15 up into the overflow chamber 25. It is to be appreciated by a person of skill in the art that once the pressure on the fluid has subsided, the print fluid levels will return to the state shown in FIG. 1. In this example, the print fluid is pushed up through the return channel 30 as well as flows back into the feeder tank 15 through the same return channel 30. In other examples, there may be a separate channel through which fluid is pushed into the overflow chamber 25 for different orientations such that the return channel 30 is to receive print fluid flowing back to the feeder tank 15 from the overflow chamber 25.

In the present example, both the feeder tank 15 and the overflow chamber 25 below the nozzle. It is to be appreciated by a person of skill with the benefit of this description that by positioning the feeder tank 15 and the overflow chamber 25 below the nozzle and by venting the surface of the print fluid in the feeder tank 15 or the overflow chamber 25 to atmospheric pressure, a natural backpressure is maintained at the nozzle. Accordingly, the backpressure will reduce drool at the nozzle by applying a force on the print fluid in the line between the outlet port of the feeder tank and the nozzle of the print head assembly even if the level of the print fluid rises into the overflow chamber 25 due more print fluid entering the feeder tank 15.

Figure 3:
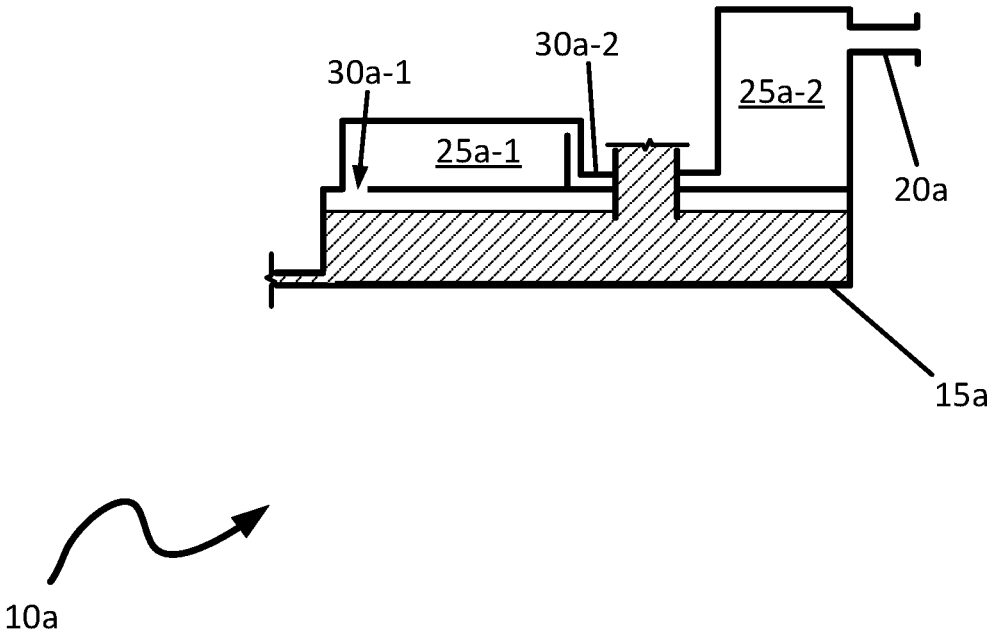
FIG. 3 is a schematic representation of another example apparatus to deliver print fluid to a nozzle of a print head assembly with multiple overflow chambers.

Referring to FIG. 3, another example of an apparatus to deliver print fluid to a nozzle of a print head assembly is generally shown at 10*a*. Like components of the apparatus 10*a* bear like reference to their counterparts in the apparatus 10, except followed by the suffix "a". The apparatus 10*a* may be a part of a printing device or a sub-component of the printing device to deliver print fluid from a tank to the media. The apparatus 10*a* includes a feeder tank 15*a*, a vent port 20*a*, overflow chambers 25*a*-1 and 25*a*-2 (generically, these overflow chambers are referred to herein as "overflow chamber 25*a*" and collectively they are referred to as "overflow chambers 25*a*", this nomenclature is used elsewhere in this description), and channels 30*a*-1 and 30*a*-2.

The overflow chambers 25*a* are in fluidic communication with the feeder tank 15*a*. In the present example, the overflow chambers 25*a* are both also disposed at a position relatively lower than nozzle of the printing apparatus. The overflow chambers 25*a* are to receive print fluid from the feeder tank 15*a* in series. In the present example, the overflow chamber 25*a*-1 is in fluidic communication with the feeder tank 15*a*. Furthermore, the overflow chamber 25*a*-2 is in fluidic communication with the overflow chamber 25*a*-1. The overflow chamber 25*a*-2 also includes the vent port 20*a* disposed thereon to vent the feeder tank 15*a* to atmosphere. Accordingly, as print fluid is pushed into the overflow chamber 25*a*-1, the overflow chamber 25*a*-1 is to fill substantially prior to print fluid being pushed into the overflow chamber 25*a*-2. The manner by which print fluid may enter the overflow chambers 25*a* is not particularly limited and each overflow chamber 25*a* is generally to provide pressure relief to the print head assembly and reduce the likelihood of leakage from the vent port 20*a*.

It is to be appreciated that the location and placement of the overflow chambers 25*a* is not particularly limited. In the present example, the overflow chamber 25*a*-1 is substantially at the same level as the overflow chamber 25*a*-2. In other examples, the overflow chamber 25*a*-2 may be disposed at a higher position above the overflow chamber 25*a*-1. Accordingly, when the overflow chambers 25*a* are stacked on top of each other, gravity may assist in the return of the feeder tank 15*a* when the pressure pushing the print fluid into the overflow chambers 25*a* subsides.

The return path for print fluid in the overflow chambers 25*a* to return to the feeder tank 15*a* includes the channel 30*a*-1 and the channel 30*a*-2. The return path is to allow for print fluid in the overflow chambers 25*a* to return to the feeder tank 15*a* upon the pressure being applied to the feeder tank 15*a* subsiding. In the present example, the overflow chambers 25*a* are both disposed above the feeder tank 15 and the return path between the feeder tank 15*a* and the overflow chamber 25*a*-2 includes flowing through the channel 30*a*-2 and 30*a*-1 after passing through the overflow chamber 25*a*-1. Accordingly, when the pressure in the feeder tank 15*a* subsides, gravity and the external pressure from the vent port 20*a* will cause the print fluid in overflow chambers 25*a* to naturally return to the feeder tank 15*a*. In the present example, print fluid in the overflow chamber 25*a*-2 will be pushed back into the overflow chamber 25*a*-1 via the channel 30*a*-2. Once the overflow chamber 25*a*-2 is empty, the pressure from the vent port 20*a* will push the print fluid in the overflow chamber 25*a*-1 into the feeder tank 15*a* via the channel 30*a*-1.

Figure 4:
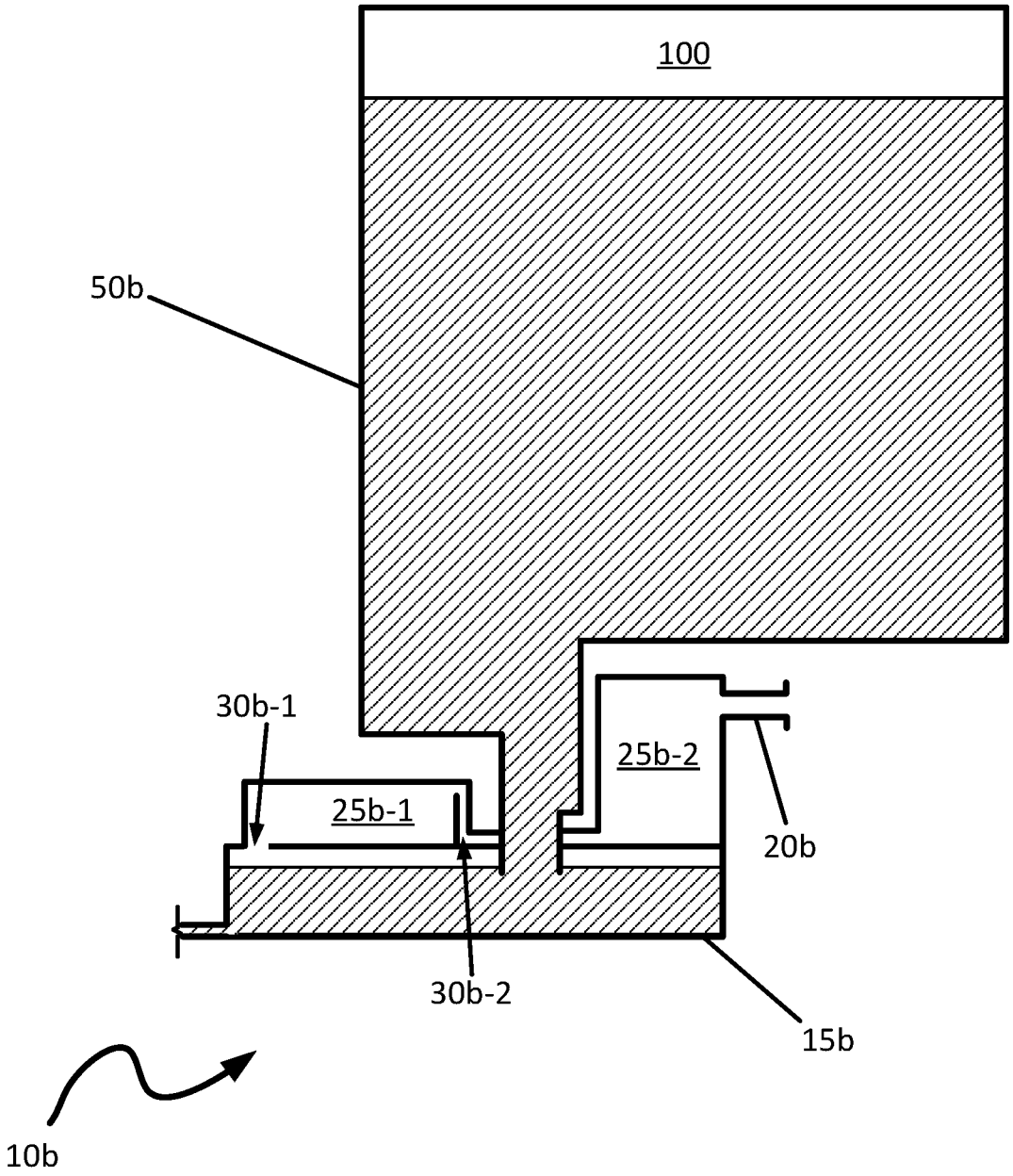
FIG. 4 is a schematic representation of another example apparatus with a storage tank to deliver print fluid to a nozzle of a print head assembly with a refill port.

Referring to FIG. 4, another example of an apparatus to dispense print fluid onto media is generally shown at 10*b*. Like components of the apparatus 10*b* bear like reference to their counterparts in the apparatus 10*a*, except followed by the suffix "b". The apparatus 10*b* may be a part of a printing device or a sub-component of the printing device to deliver print fluid from a tank to the media. The apparatus 10*b* includes a feeder tank 15*b*, a vent port 20*b*, overflow chambers 25*b*-1 and 25*b*-2. In addition, the apparatus 10*b* includes a storage tank 50*b*.

The storage tank 50*b* is to store a bulk amount of print fluid. In the present example, the storage tank 50*b* includes a housing having walls to define a cavity. The cavity is not limited and may be any shape designed to store the print fluid during operation of the printing device. For example, the storage tank 50*b* may have a unique shape to complement a design of the printing device. In addition, the storage tank 50*b* may also be formed of a part of single unitary body along with the other components, such as the feeder tank 15*b* and the overflow chambers 25*b*. The storage tank 50*b* may include a port to receive print fluid from an external source such as a bottle in some examples or a larger external tank via tubing during a filling process. In other examples, the storage tank 50*b* may be detachable from the feeder tank 15*b* to be filled separately. In the present example, the storage tank 50*b* has a capacity of about 90 cubic centimeters to about 160 cubic centimeters. However, in other examples, the storage tank 50*b* may have a larger or smaller capacity depending on the design and intended purpose of the printing device. The shape of the storage tank 50*b* is not particularly limited. For example, the present example illustrates the storage tank 50*b* to complement other features of the apparatus 10*b* to use the space more efficiently. Furthermore, the storage tank 50*b* may be formed of the same unitary body as the other features of the apparatus 10*b*. In other examples, the storage tank 50*b* may be another shape such as substantially cylindrical or rectangular in shape.

The position of the storage tank 50*b* in the printing device is not particularly limited. In the present example, the storage tank 50*b* is positioned at a relatively high position on the printing device as discussed in greater detail below. In particular, the storage tank 50*b* may be positioned above a nozzle of a print head assembly to which the storage tank 50*b* is to supply the print fluid. Accordingly, the storage tank 50*b* is to be easily accessible to a user or an administrator of the printing device for servicing, such as refilling the storage tank 50*b* when empty.

It is to be appreciated that in some examples, the storage tank 50*b* may be a separate component and not be part of the apparatus 10*b*. For example, the storage tank 50*b* may be a consumable part connectable to the feeder tank 15*b* and is to be sold separately as a part to be replaced when empty similar to a disposable ink cartridge. In examples where the storage tank 50*b* is a separate consumable part, it is to be appreciated that the user experience may be simplified because the replacement of the entire part is simpler than refilling the storage tank 50*b*.

Similar to the apparatus 10*a*, the return path for print fluid in the overflow chambers 25*b* to return to the feeder tank 15*b* includes the channel 30*b*-1, the channel 30*b*-2, and the overflow chamber 25*b*-2. The return path is to allow for print fluid in the overflow chambers 25*b* to return to the feeder tank 15*b* upon the end of an overflow condition.

Figure 5:
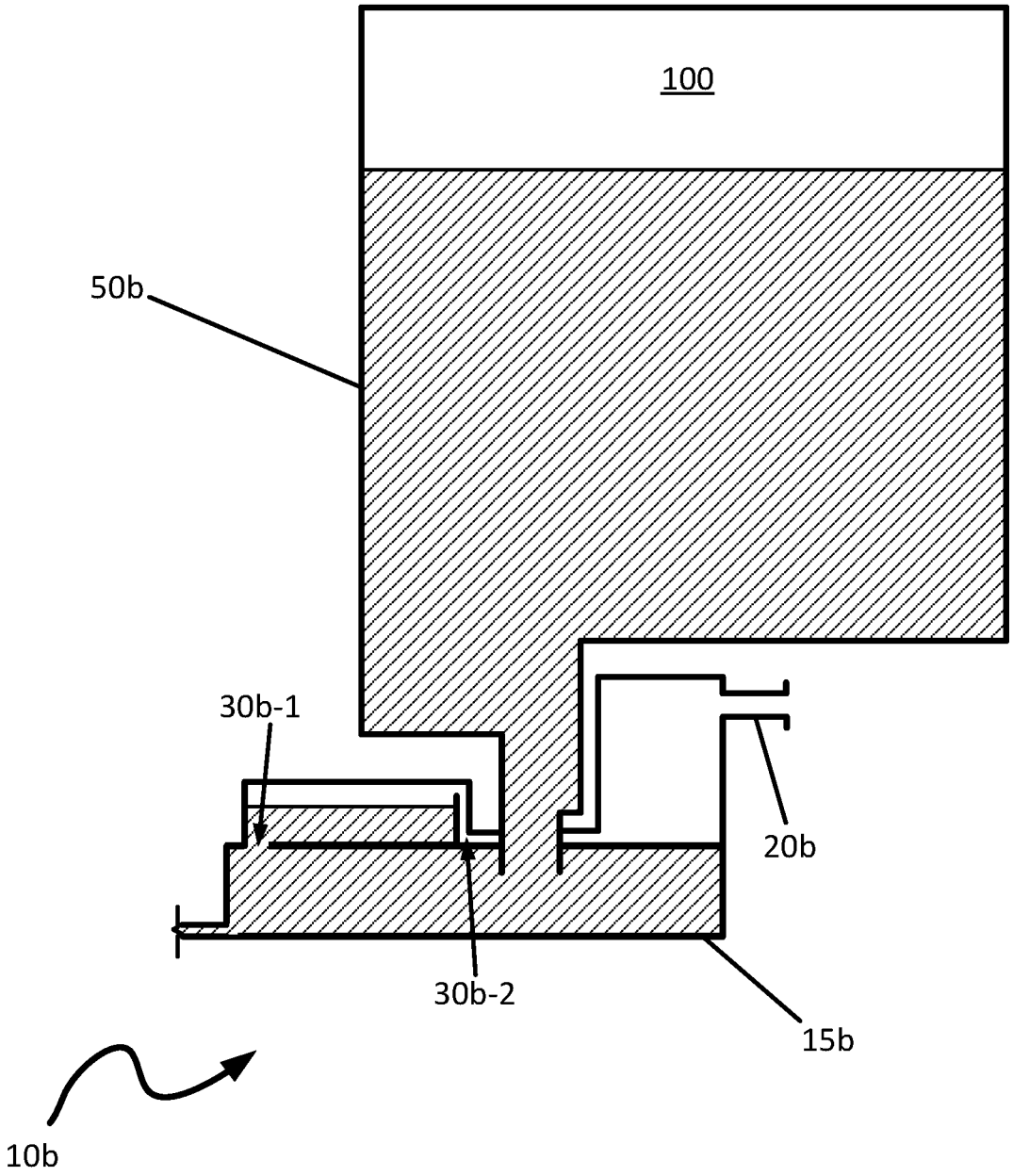
FIG. 5 is a schematic representation the apparatus shown in FIG. 4 in a first overflow condition.
Figure 6:
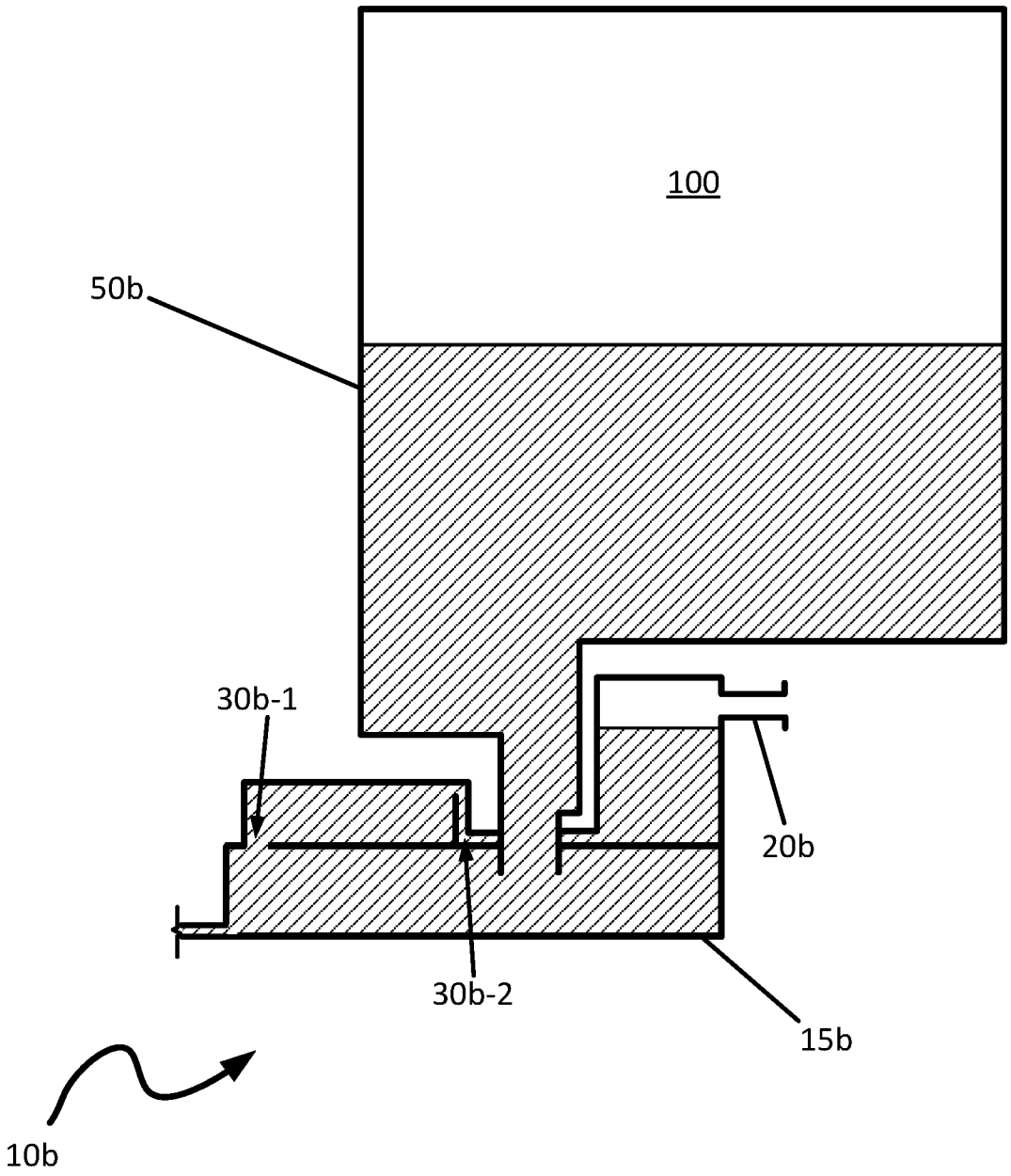
FIG. 6 is a schematic representation the apparatus shown in FIG. 4 in a second overflow condition.

Referring to FIGS. 4 to 6, the apparatus 10*b* is shown in three different states where pressure from the air pocket 100 at the top of the storage tank 50*b* may be applied to the print fluid in the storage tank 50*b* causing the level of the print fluid in the feeder tank 15*b* to rise. As shown in FIG. 5, the print fluid is pushed from the feeder tank 15*b* up into the overflow chamber 25*b*-1 during a first overflow condition. Accordingly, under the first overflow condition, the overflow chamber 25*b*-1 receives an overflow of print fluid from the feeder tank 15*b* via the channel 30*b*-1. It is to be appreciated that the cause of the first overflow condition is not limited. For example, the first overflow condition may be caused by in increase in temperature or a decrease in ambient temperature. Upon the end of the first overflow condition, the print fluid would no longer be subject to additional pressure and flow back into the feeder tank 15*b* via the channel 30*b*-1.

Referring to FIG. 6, if the pressure on the print fluid in the storage tank 50*b* continues to rise, such as with a warming temperature to expand the air pocket 100 in the storage tank 50*b*, a second overflow condition may occur. During the second overflow condition, the overflow chamber 25*b*-1 will reach capacity and additional print fluid is pushed into the overflow chamber 25*b*-2 via the channel 30*b*-2 as shown in FIG. 6. Accordingly, the chamber 25*b*-2 provides additional capacity to store print fluid in response to the second overflow condition by receiving the print fluid pushed out of the overflow chamber 25*b*-1. Upon the end of the second overflow condition, the print fluid would no longer be subject to additional pressure and flow back into the overflow chamber 25*b*-1 via the channel 30*b*-2. It is to be appreciated that since the air pocket 100 in the storage tank 50*b* is contracting to restore original print levels, the external pressure from the vent port 20*b* may push the print fluid out of the overflow chamber 25*b*-1 via the channel 30*b*-2.

It is to be appreciated by a person of skill in the art that once the pressure on the fluid has subsided, the print fluid levels will return to the state shown in FIG. 1.

Figure 7:
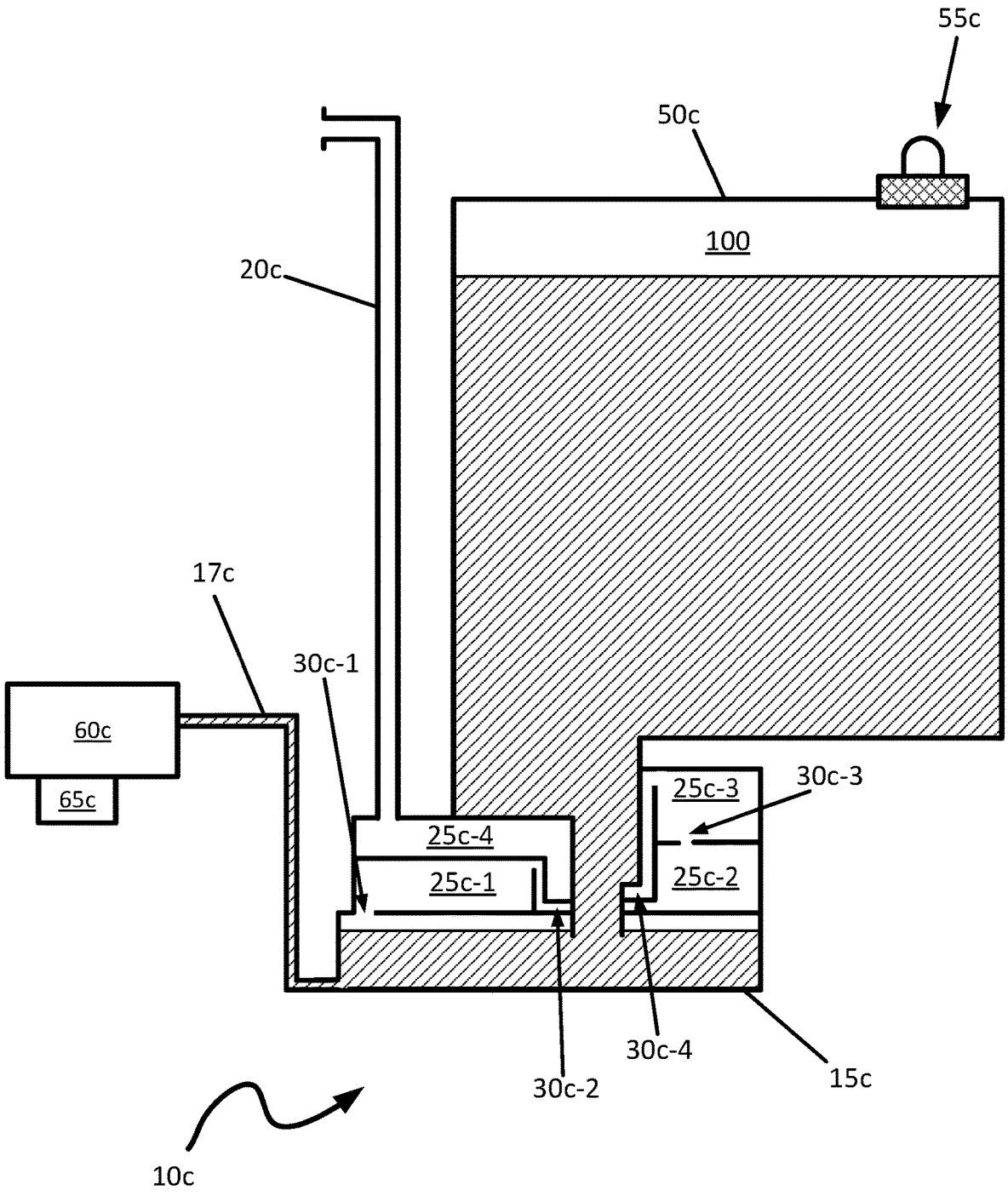
FIG. 7 is a schematic representation of another example apparatus to deliver print fluid to a nozzle of a print head assembly with a refill port.

Referring to FIG. 7, another example of an apparatus to dispense print fluid onto media is generally shown at 10*c*. Like components of the apparatus 10*c* bear like reference to their counterparts in the apparatus 10*a*, except followed by the suffix "c". The apparatus 10*c* may be a part of a printing device or a sub-component of the printing device to deliver print fluid from a tank to the media. The apparatus 10*c* includes a feeder tank 15*c*, a vent port 20*c*, overflow chambers 25*c*-1, 25*c*-2, 25*c*-3, and 25*a*-4, and channels 30*c*-1, 30*c*-2, 30*c*-3, and 30*a*-4. In addition, the apparatus 10*c* may include a storage tank 50*c* having a refill port 55*c* and a print head assembly 60*c* with a nozzle 65*c*.

The storage tank 50*c* is to store a bulk amount of print fluid. In the present example, the storage tank 50*c* includes a housing having walls to define a cavity. In the present example, the storage tank 50*c* includes a refill port 55*c* to refill the storage tank 50*c* by adding print fluid from an external source such as a bottle or print fluid line. The refill port 55*c* is not particularly limited and is generally to interface with a print fluid supply, such as a bottle of print fluid having a complementary interface. For example, the refill port 55*c* may be a simple mechanism such as a hole through which print fluid may be added.

In the present example, the refill port 55*c* provides an airtight seal such that air is exchanged with the print fluid supply. The refill port 55*c* may include an air vent (not shown) and a fluid passage (not shown). During refilling of the storage tank 50*c* print fluid from the print fluid supply may flow into the storage tank 50*c*. As the storage tank 50*c* fills with print fluid, air is to be displaced and exits through the air vent into print fluid source. In the present example where the print fluid source is a bottle of print fluid, air from the storage tank 50*c* replaces the print fluid in the bottle. Accordingly, the filling process in the present example is carried out in a closed system. By maintaining the closed system, the amount of liquid entering the storage tank 50*c* will not exceed the amount of volume available in the storage tank 50*c*. Accordingly, this may be to reduce potential wastage of liquid during the filling process.

Furthermore, in the present example, the vent port 20*c* extends further up from the feeder tank 15*c*. It is to be appreciated that the exact design of the vent port 20*c* is not particularly limited. The vent port 20*c* is to vent the feeder tank 15*c* to atmospheric pressure. By extending the vent port 20*c* further from the feeder tank 15*c*, additional tip-resistant features may be added to reduce the likelihood of print fluid leakage in the event of a tipping of the printing device. For example, various valves and air pathways may be introduced to trap print fluid from escaping the feeder tank 15*c*.

In the present example, the feeder tank 15*c* is in fluidic communication with the nozzle 65*c* of the print head assembly 60*c*. In the present example, the feeder tank 15*c* includes a fluid line 17*c* leading to the print head assembly 60*c* to maintain the fluidic communication. Furthermore, the feeder tank 15*c* is to be disposed within the printing device below the nozzle 65*c* at a relatively lower position. It is to be appreciated by a person of skill with the benefit of this description that by positioning the feeder tank 15*c* below the nozzle 65*c* and by venting the surface of the print fluid in the feeder tank 15*c* to atmospheric pressure via the vent port 20*c*, a natural backpressure is maintained at the nozzle 65*c* to reduce drool from the nozzle.

It is to be understood by a person of skill with the benefit of this description that various combinations are possible.

For example, each of the apparatus 10 may be modified to include a storage tank. Similarly, the apparatus 10*c* with four overflow chambers may be modified to omit the storage tank 50*c*. It is to be appreciated that other combinations are also contemplated.

It should be recognized that features and aspects of the various examples provided above may be combined into further examples that also fall within the scope of the present disclosure.

What is claimed is:

1. An apparatus comprising:

a feeder tank to provide print fluid to a nozzle, the feeder tank disposed below the nozzle to maintain a backpressure;

a vent port to vent the feeder tank to atmosphere;

an overflow chamber in fluidic communication with the feeder tank, the overflow chamber disposed below the nozzle; and a return channel disposed on the overflow chamber to allow print fluid in the overflow chamber to return to the feeder tank.

2. The apparatus of claim 1, wherein the overflow chamber is disposed above the feeder tank.

3. The apparatus of claim 2, wherein the overflow chamber and the feeder tank form a unitary body.

4. The apparatus of claim 3, wherein the unitary body is molded.

5. The apparatus of claim 1, further comprising a storage tank in fluidic communication with the feeder tank, wherein the storage tank is to store a bulk amount of print fluid.

6. The apparatus of claim 5, further comprising a refill port disposed on the storage tank to add print fluid to the storage tank.

7. An apparatus comprising:

a storage tank disposed above a nozzle, wherein the storage tank is to store a bulk amount of print fluid;

a feeder tank in fluidic communication with the storage tank to provide print fluid to the nozzle, the feeder tank disposed below the nozzle to maintain a backpressure at the nozzle;

a first overflow chamber in fluidic communication with the feeder tank, the first overflow chamber disposed below the nozzle;

a second overflow chamber in fluidic communication with the first overflow chamber, the second overflow chamber disposed below the nozzle; and a return path for print fluid in the second overflow chamber to flow from the second overflow chamber to the first overflow chamber and from the first overflow chamber to the feeder tank.

8. The apparatus of claim 7, wherein the first overflow chamber is disposed above the feeder tank.

9. The apparatus of claim 8, wherein the second overflow chamber is disposed above the first overflow chamber.

10. The apparatus of claim 9, further comprising a vent port disposed on the second overflow chamber.

11. The apparatus of claim 7, further comprising an exchange port to connect the storage tank to the feeder tank.

12. The apparatus of claim 11, wherein return path is arranged in the second overflow chamber to allow the print fluid to flow due to gravity.

13. An apparatus comprising:

a print head assembly to draw print fluid;

a nozzle disposed on the print head assembly, wherein the nozzle is to dispense the print fluid onto a media;

a feeder tank in fluidic communication with the print head assembly, the feeder tank to provide print fluid to the nozzle, the feeder tank disposed below the nozzle to maintain a backpressure at the nozzle;

a first overflow chamber in fluidic communication with the feeder tank to receive print fluid from the feeder tank via a first channel in response to a first overflow condition at the feeder tank; and a second overflow chamber in fluidic communication with the first overflow chamber to receive print fluid from the first overflow chamber via a second channel in response to a second overflow condition at the feeder tank.

14. The apparatus of claim 13, wherein the print fluid flows from the second overflow chamber to the first overflow chamber after the second overflow condition ends.

15. The apparatus of claim 14, wherein the print fluid flows from the first overflow chamber to the feeder tank after the first overflow condition ends.

* * * * *